US007312574B2

(12) United States Patent
Kim et al.

(10) Patent No.: US 7,312,574 B2
(45) Date of Patent: Dec. 25, 2007

(54) PLASMA DISPLAY PANEL HAVING DISPLAY ELECTRODE TERMINALS LOCATED ON THE SAME SIDE, AND PLASMA DISPLAY DEVICE INCORPORATING THE SAME

(75) Inventors: Joon-Yeon Kim, Suwon-si (KR); Jeong-Nam Kim, Suwon-si (KR); Gab-Sick Kim, Suwon-si (KR); Sung-Chun Cho, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 11/137,217

(22) Filed: May 24, 2005

(65) Prior Publication Data

US 2005/0280367 A1 Dec. 22, 2005

(30) Foreign Application Priority Data

Jun. 17, 2004 (KR) ..... 10-2004-0044867

(51) Int. Cl.
*H01J 17/49* (2006.01)

(52) U.S. Cl. ..... 313/582; 313/584; 313/586; 313/587; 345/37; 345/70

(58) Field of Classification Search ..... 313/582–587; 345/60, 62, 66
See application file for complete search history.

(56) References Cited

U.S. PATENT DOCUMENTS 5,998,935 A * 12/1999 Marcotte ..... 315/169.4
6,320,326 B1 * 11/2001 Shino et al. ..... 315/169.4
6,534,914 B2 3/2003 Amemiya et al.
6,961,031 B2 11/2005 Lee et al.
2001/0019318 A1 * 9/2001 Sano et al. ..... 345/60
2001/0026130 A1 * 10/2001 Amemiya et al. ..... 313/586
2003/0080925 A1 * 5/2003 Lee ..... 345/60
2003/0184229 A1 * 10/2003 Kim et al. ..... 313/587
2004/0041522 A1 * 3/2004 Takada et al. ..... 313/586
2005/0285523 A1 * 12/2005 Fujitani ..... 313/582

FOREIGN PATENT DOCUMENTS

CN 1283864 A 2/2001
CN 1452147 A 10/2003

* cited by examiner

*Primary Examiner*—Joseph Williams
*Assistant Examiner*—Hana Asmat Sanei
(74) *Attorney, Agent, or Firm*—Christie, Parker & Hale, LLP

(57) ABSTRACT

For reducing EMI and simplifying driving circuits, a plasma display panel includes a first substrate and a second substrate disposed facing each other, a plurality of barrier ribs disposed between the first and second substrates and forming a plurality of discharge cells, a phosphor layer formed in each of the discharge cells, a plurality of address electrodes formed on the second substrate, and a plurality of display electrodes formed on the first substrate in a direction crossing the plurality of address electrodes. Terminals of the plurality of display electrodes are located at a same side of the plasma display panel between the first substrate and the second substrate.

3 Claims, 5 Drawing Sheets

PLASMA DISPLAY PANEL HAVING DISPLAY ELECTRODE TERMINALS LOCATED ON THE SAME SIDE, AND PLASMA DISPLAY DEVICE INCORPORATING THE SAME

CROSS-REFERENCE TO RELATED APPLICATION

This application claims priority to and the benefit of Korean Patent Application No. 10-2004-0044867 filed on Jun. 17, 2004 in the Korean Intellectual Property Office, the entire content of which is incorporated herein by reference.

BACKGROUND OF THE INVENTION

1. Field of the Invention

The present invention relates to a plasma display panel for displaying an image.

2. Description of the Related Art

Generally, a plasma display panel (PDP) is a display device which excites phosphors with vacuum ultraviolet (VUV) rays radiated from plasma obtained through gas discharging, and displays desired images by using visible light of red R, green G, and blue B colors generated by the excited phosphors. The PDP has been in the spotlight as a flat panel display for TV and industrial purposes with several advantages. The PDP can realize a very large screen size of 60" (~152.4 cm) or more with a thickness of 10 cm or less, and involves excellent color representation, without image distortion due to viewing angles, since it is a self emissive display, like a cathode ray tube (CRT). The PDP further involves high productivity and low production cost as it is made in a more simplified manner compared to an LCD.

An alternating current type PDP ("AC PDP") includes a rear substrate and a front substrate. Address electrodes are formed on the rear substrate and covered by a dielectric layer. Between the address electrodes, barrier ribs are disposed in a striped arrangement on the dielectric layer. A phosphor layer for generating visible light of red R, green G, or blue B color is formed between the barrier ribs. Display electrodes are formed on the front substrate facing the rear substrate. The display electrodes are arranged in pairs, and each display electrode includes a transparent electrode and a bus electrode. The display electrodes extend in a direction crossing the address electrodes. A dielectric layer and an MgO protective layer are consecutively formed on the front substrate, covering the display electrodes. A discharge cell is formed at each area where the address electrodes on the rear substrate cross a pair of display electrodes on the front substrate. Millions of discharge cells are arranged in the PDP in a matrix format. The discharge cells of an AC PDP arranged in a matrix format are driven by utilizing memory characteristics.

In more detail, in order to generate a discharge between X and Y electrodes that form a pair of display electrodes, a potential difference therebetween is required to be more than a specific voltage, which is called a discharge firing voltage Vf. In this case, a scan pulse and an address pulse Va of a discharge cell are respectively applied to the Y electrode and the address electrode, an address discharge is generated between the two electrodes, and thus the discharge cell is selected. Plasma is formed in such a selected discharge cell, and electrons and positive ions therein shift toward the electrode of opposite polarity.

Since the electrodes of the AC PDP are covered with dielectric layers, most of the shifted space charges (i.e., the above-mentioned electrons and ions) are accumulated thereon. Accordingly, the net space potential between the Y electrode and the address electrode becomes smaller than the originally applied address voltage Va so that the discharge becomes weak and finally vanishes.

In this case, a relatively small amount of electrons is accumulated on the X electrode, and a relatively large amount of ions is accumulated on the Y electrode. The charges accumulated on the dielectric layer covering the X and Y electrodes are called wall charges Qw, and the space voltage formed between the X and Y electrodes due to the wall charges is called a wall voltage Vw.

When a predetermined voltage (called a sustain voltage Vs) is subsequently applied between the X and Y electrodes, a discharge is generated in the discharge cell to produce VUV rays, in the case that the sum Vs+Vw of the sustain voltage Vs and the wall voltage Vw is higher than the discharge firing voltage Vf. The VUV rays excite the relevant phosphors, and visible rays produced thereby are emitted through the transparent front substrate However, for a discharge cell that has not experienced such an address discharge between the Y electrode and the address electrode (i.e., a discharge cell to which the address voltage Va is not applied), wall charges are not accumulated on the X and Y electrodes, and consequently the wall voltage is not formed between the X and Y electrodes. In this case, only the sustain voltage Vs applied to the X and Y electrodes acts in the discharge cell. As the sustain voltage Vs is lower than the discharge firing voltage Vf, no discharge is caused in the gas space between the X and Y electrodes.

Terminals of the X and Y electrodes of the display electrodes are located at opposite sides of the PDP between the front and rear substrates. The terminals of the X electrodes are connected to a driving board (typically called an X board) for driving the X electrodes, through a flexible printed circuit (FPC). The terminals of the Y electrodes are connected to another driving board (typically called a Y board) disposed opposite to the X-board. The X and Y boards may be fabricated in the form of a printed circuit board assembly (PBA). Therefore, a path for applying the sustain voltage to the X and Y electrodes is elongated, and accordingly electromagnetic interference (EMI) is increased during the operation of the PDP. In addition, such a PDP requires separate X and Y boards, and accordingly driving circuits become complex.

The information disclosed in this Background of the Invention section is only for enhancement of understanding of the background of the invention, and therefore, unless explicitly described to the contrary, it should not be taken as an acknowledgement or any form of suggestion that this information forms the prior art that is already known in this country to a person of ordinary skill in the art.

SUMMARY OF THE INVENTION

In exemplary embodiments of the present invention, a plasma display panel and a plasma display device having features of reduced EMI and a simplified driving circuit is provided.

In an exemplary embodiment according to the present invention, a plasma display panel including a first substrate and a second substrate disposed facing each other, and a plurality of barrier ribs disposed between the first and second substrates and forming a plurality of discharge cells, is provided. A phosphor layer is formed in each of the discharge cells, and a plurality of address electrodes are formed on the second substrate. A plurality of display electrodes are formed on the first substrate in a direction crossing the plurality of address electrodes. Terminals of the plurality of display electrodes are located at a same side of the plasma display panel between the first substrate and the second substrate.

The plurality of display electrodes may include first and second electrodes disposed opposite one another in a discharge area of each of the discharge cells, and the terminals of the first and second electrodes may be located at the same side of the plasma display panel between the first substrate and the second substrate.

The first and second electrodes may respectively include a bus electrode and a plurality of protrusion electrodes. The bus electrode may be elongated in a direction crossing a length direction of the address electrodes, the bus electrode being formed corresponding to respective discharge cells in pairs, and the protrusion electrodes may protrude from the bus electrode toward a center of the respective discharge cells.

The first and second electrodes may repeatedly correspond to respective discharge cells in an order of the first electrode and the second electrode along an elongation direction of the address electrodes.

In another exemplary embodiment according to the present invention, a plasma display panel including a first substrate and a second substrate disposed facing each other, and a plurality of barrier ribs disposed between the first and second substrates and forming a plurality of discharge cells, is provided. A phosphor layer is formed in each of the discharge cells, and a plurality of address electrodes are formed on the second substrate. A plurality of display electrodes are formed on the first substrate in a direction crossing the plurality of address electrodes. The plurality of display electrodes include first and second electrodes disposed opposite one another in a discharge area of each of the discharge cells. The first electrode includes a first terminal located at a same side of the plasma display panel as a second terminal of the second electrode, a first elongated portion elongated from the first terminal toward an opposite side thereof, and a second elongated portion connected with the first elongated portion and formed in parallel to the first elongated portion.

The second electrode may be elongated from the second terminal toward an opposite side thereof. The first elongated portion of the first electrode may form a non-discharge portion, and the second elongated portion of the first electrode may be connected with the non-discharge portion and is elongated back toward the first terminal so as to form a discharge portion.

The first elongated portion may be formed on the first substrate corresponding to one of the barrier ribs that forms a non-discharge area.

A cross-section of the first elongated portion may be formed larger than that of the second elongated portion.

The first and second electrodes may repeatedly correspond to respective discharge cells in an order of the first electrode and the second electrode.

The second elongated portion of the first electrode may include a plurality of elongated portions branched from one first elongated portion, and may respectively be disposed corresponding to adjacent discharge cells, in an elongated direction of the address electrodes. In this case, the first and second electrodes may repeatedly correspond to respective discharge cells in an order of the second electrode, the first electrode, and the second electrode along an elongation direction of the address electrodes.

The second electrode may include a third elongated portion elongated from the second terminal toward an opposite side thereof, and a fourth elongated portion connected with the third elongated portion and formed in parallel to the third elongated-portion. In this case, the first elongated portion of the first electrode may form a discharge portion, and the second elongated portion of the first electrode connected with the first elongated portion may be elongated back toward the first terminal so as to form a discharge portion. In addition, the third elongated portion of the second electrode may form a discharge portion, and the fourth elongated portion of the second electrode may be connected with the discharge portion and may be elongated back toward the second terminal so as to form a discharge portion.

The first and second electrodes may repeatedly correspond to three adjacent discharge cells in an order of the second electrode, the first electrode, the second electrode, and the first electrode along an elongation direction of the address electrodes.

The plasma display panel according to an exemplary embodiment of the present invention may further include a third electrode disposed between the first and second electrodes.

The third electrode may include a plurality of bus electrodes and a transparent electrode, wherein the plurality of bus electrodes are elongated in a direction crossing a length direction of the address electrodes and formed in pairs corresponding to respective discharge cells, and the transparent electrode has wider width than the bus electrode.

In yet another exemplary embodiment according to the present invention, a plasma display device including a plasma display panel and a single integral driving board is provided. The plasma display panel includes a first substrate and a second substrate disposed facing each other, a plurality of barrier ribs disposed between the first and second substrates and forming a plurality of discharge cells, a phosphor layer formed in each of the discharge cells, a plurality of address electrodes formed on the second substrate, and a plurality of display electrodes formed on the first substrate in a direction crossing the plurality of address electrodes. The single integral driving board drives the plurality of display electrodes, and is connected to terminals of the display electrodes through at least one flexible printed circuit, wherein the terminals are located at a same side of the plasma display panel between the first and second substrates.

The display electrodes having the terminals that are located at the same side of the plasma display panel include a sustain electrode and a scan electrode.

DETAILED DESCRIPTION

Exemplary embodiments of the present invention will hereinafter be described in detail with reference to the accompanying drawings.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature, and not restrictive.

Figure 1:
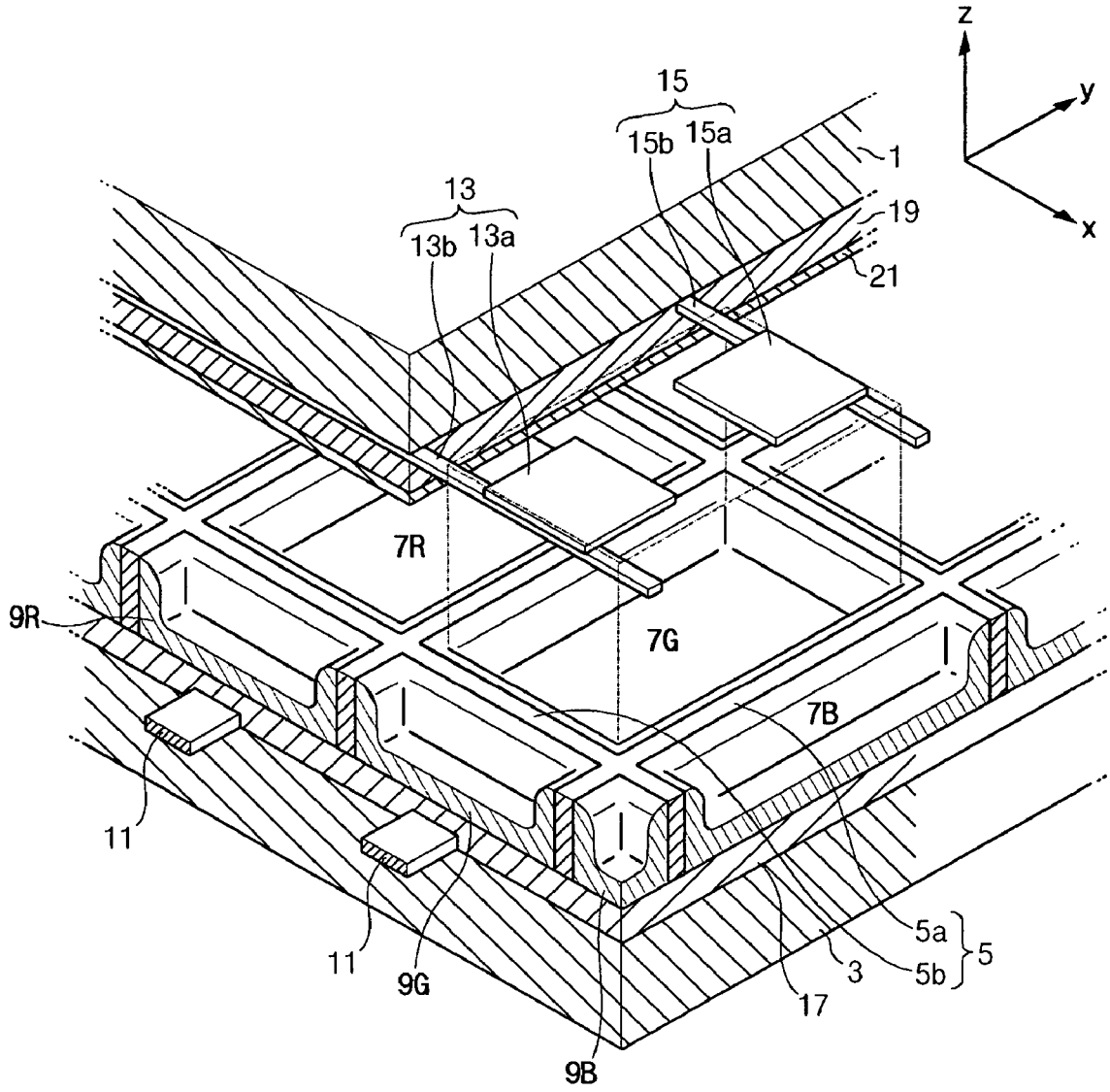
FIG. 1 is a partially exploded perspective view of a PDP according to a first exemplary embodiment of the present invention.

FIG. 1 is a partially exploded perspective view of a PDP according to a first exemplary embodiment of the present invention.

In a PDP according to the present embodiment, a first substrate (hereinafter called a front substrate) 1 and a second substrate (hereinafter called a rear substrate) 3 are combined facing each other. A plurality of barrier ribs 5 are arranged in a space between the front substrate 1 and the rear substrate 3. The barrier ribs 5 dividedly form a plurality of discharge cells 7R, 7G, and 7B for making a plasma discharge. The discharge cells 7R, 7G, and 7B are filled with a discharge gas (typically a Ne—Xe compound gas) therein, and phosphor layers 9R, 9G, and 9B for respectively generating visible lights of red (R), green (G), and blue (B) colors are formed on interior walls thereof.

Address electrodes 11 are elongated on the rear substrate 3 along a y-axis direction shown in FIG. 1. The address electrodes 11 are arranged in an x-axis direction with an interval corresponding to the discharge cells 7R, 7G, and 7B. On the front substrate 1, display electrodes 13 and 15 are elongated in a direction crossing the address electrodes 11, i.e., in the x-axis direction in FIG. 1. The display electrodes 13 and 15 are arranged in the y-axis direction with an interval corresponding to the discharge cells 7R, 7G, and 7B. The barrier ribs 5 provided in a space between the front and rear substrates 1 and 3 include first barrier rib members 5*a* and second barrier rib members 5*b* that form a closed contour of the discharge cells 7R, 7G, and 7B. The first barrier rib members 5*a* are elongated in the y-axis direction and arranged parallel to each other. The second barrier rib members 5*b* are elongated in the x-axis direction so as to cross the first barrier rib members 5*a* and arranged parallel to each other.

FIG. 1 exemplarily illustrates a closed barrier rib configuration of a closed contour in which the discharge cells 7R, 7G, and 7B are formed by the first and second barrier rib members 5*a* and 5*b* that are respectively elongated in the x- and y-axis directions so as to cross each other. However, the present invention should not be understood to be limited thereto, since various variations may be applicable within the spirit of the present invention. For example, the barrier ribs may be formed in a striped structure having only the first barrier rib members 5*a*. In addition, when both of the first and second barrier rib members 5*a* and 5*b* are used, the discharge cells 7R, 7G, and 7B may be formed in various shapes, e.g., a hexagonal or octagonal shape, depending on the pattern of the first and second barrier rib members 5*a* and 5*b*.

The address electrodes 11 are covered with a first dielectric layer 17 enabling accumulation of wall charges in the discharge cells 7R, 7G, and 7B, so as to generate an address discharge. The first dielectric layer 17 should be formed of a white colored dielectric material so as to enable sufficient reflectance of visible light.

For generating a sustain discharge in the discharge cells 7R, 7G, and 7B after the address discharge with the address electrodes 11, the display electrodes 13 and 15 crossing the address electrodes 11 include a first electrode (hereinafter called an X electrode) 13 and a second electrode (hereinafter called a Y electrode) 15 disposed opposite to each other with respect to the discharge cells 7R, 7G, and 7B, and they are covered with a dielectric layer 19 and an MgO protective layer 21.

Figure 2:
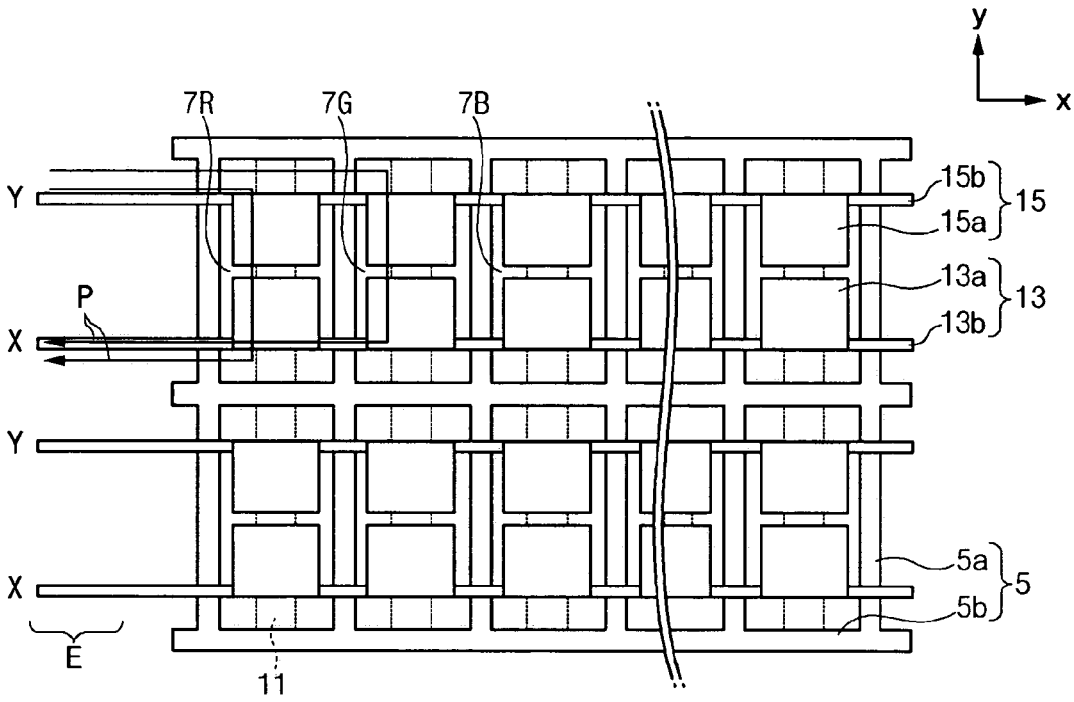
FIG. 2 is a top plan view showing principal portions of FIG. 1.

FIG. 2 is a top plan view showing principal portions of FIG. 1.

Terminals of the display electrodes (i.e., the X and Y electrodes) 13 and 15 are located at the same side of the PDP, i.e., at the negative x-axis direction from the PDP in FIG. 2, between the front and rear substrates 1 and 3. In this and other described embodiments of the present invention, the display electrodes or the terminals thereof may also be described as being drawn out in a same x-axis direction from the PDP.

Figure 3:
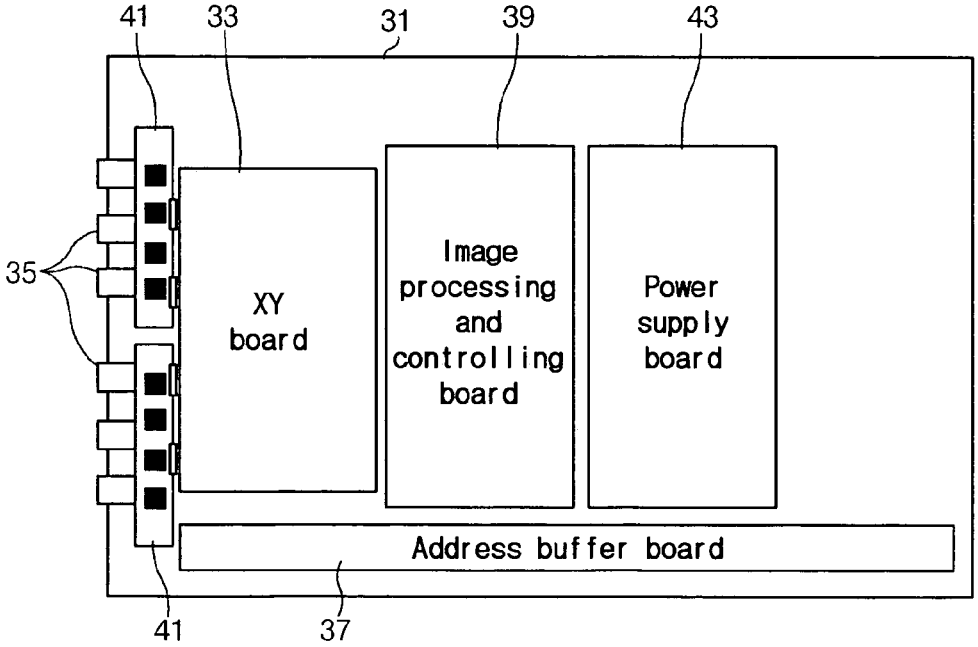
FIG. 3 is a top plan view of a plasma display device according to an exemplary embodiment of the present invention.

FIG. 3 is a top plan view of a plasma display device according to an exemplary embodiment of the present invention.

Since terminals E of the display electrodes 13 and 15 are located at the same side of the PDP (i.e., at the negative x-axis direction from the PDP in FIG. 2), a driving board (hereinafter called an XY board) 33 for driving both the X and Y electrodes may be realized as a single integral board, which is mounted to a side of a chassis base 31 opposite to a side attached with a PDP as shown in FIG. 3. The XY board may be fabricated in the form of a PBA, the same as the conventional X and Y boards. The terminals E, located at the same side of the PDP, are connected to the XY board 33 through an FPC 35. Accordingly, an area of a closed loop formed by the display electrodes 13 and 15 and the XY board 33 is decreased, and the decreased area of the closed loop reduces differential mode radiation of electromagnetic waves, which is proportional to the area of the closed loop. Therefore, according to such a configuration of display electrodes 13 and 15 and the driving board 33, EMI is reduced during an operation of the PDP. In addition, since the XY board 33 is provided as a single integral board combining the conventional X board and Y board, the driving circuit for driving the PDP may be simplified.

In addition to the XY board 33, the chassis base 31 further includes a plurality of printed circuit board assemblies (PBAs) required for driving the PDP. An address buffer board 37 is formed at an upper portion or a lower portion of the chassis base 31, depending on the configuration of the address electrodes in the PDP, although FIG. 3 only illustrates that the address buffer board 37 is formed at the lower portion. The address buffer board 37 receives an address driving control signal from an image processing and controlling board 39, and selectively applies, to the address electrodes 11, an address voltage for selecting a discharge cell to be turned on among the discharge cells 7R, 7G, and 7B.

The XY board 33 mounted on a side of the chassis base 31 is electrically connected to the terminals E of the X and Y electrodes 13 and 15 through a display electrode buffer board (hereinafter called an XY buffer board) 41. In the address period, the XY buffer board 41 sequentially applies a scan pulse for selecting a discharge cell to the Y electrodes 15. The XY board 33 receives a driving signal from the image processing and controlling board 39, and respectively applies a driving voltage to the X and Y electrodes 13 and 15. Although the XY board 33 may be fabricated to include a plurality of PBAs, it should be made as a single integral board since the terminals E are located at the same side of the PDP.

Receiving an externally provided video signal, the image processing and controlling board 39 generates control signals for driving the address electrodes 11 and the X and Y electrodes 13 and 15, and then respectively applies them to the address buffer board 37 and the XY board 33. In addition, a power supply board 43 is provided on the chassis base 31 to supply electric power for driving the PDP.

Terminals E of the X and Y electrodes 13 and 15 located at the same side of the PDP may be connected to the XY buffer board 41 in the plasma display device, according to various configurations of the display electrodes 13 and 15 as will be described hereinafter.

As describe above, the X electrode 13 and the Y electrode 15 as the display electrodes are disposed opposite to one another in a discharge area of the discharge cells 7R, 7G, and 7B. That is, the display electrodes 13 and 15 having terminals that are located at the same side of the PDP include a sustain electrode (i.e., the X electrode) and a scan electrode (i.e., the Y electrode).

The X and Y electrodes 13 and 15 respectively include protrusion electrodes 13*a* and 15*a* protruding toward centers of the discharge cells 7R, 7G, and 7B, and bus electrodes 13*b* and 15*b* for respectively applying a voltage to the protrusion electrodes 13*a* and 15*a*. The bus electrodes 13*b* and 15*b* are elongated along the x-axis direction crossing the length direction of the address electrode 11, and provided as a pair in respective discharge cells 7R, 7G, and 7B. The protrusion electrodes 13*a* and 15*a* protrude toward the centers of the discharge cells 7R, 7G, and 7B from the bus electrodes 13*b* and 15*b*.

The protrusion electrodes 13*a* and 15*a* are used for generating a plasma discharge in the discharge cells 7R, 7G, and 7B, and should be formed as transparent electrodes for improved brightness of the PDP. For example, the protrusion electrodes 13*a* and 15*a* may be formed of transparent indium tin oxide (ITO). The bus electrodes 13*b* and 15*b* are used for providing sufficient conductivity of the display electrodes by compensating high electric resistance of the protrusion electrodes 13*a* and 15*a*, and should be formed as metal electrodes. For example, the bus electrode 13*b* and 15*b* may be formed of aluminum (Al).

The terminals E may be located at the same side of the PDP according to various configurations of the X and Y electrodes 13 and 15, and FIG. 2 exemplarily illustrates that the X and Y electrodes 13 and 15 are arranged in an order of X, Y, . . . , X, and Y electrodes or Y, X, . . . , Y, and X electrodes along a series of the discharge cells 7R, 7G, and 7B in the y-axis direction (i.e., the elongated direction of the address electrodes 11).

According to such a configuration of the X and Y electrodes 13 and 15 and the terminals E that are located at the same side, a discharge current path P is established to be short, as shown by arrows in FIG. 2, in comparison to the case where the terminals of the X and Y electrodes are alternately located at opposite sides of the PDP. Therefore, a closed loop formed by the X and Y electrodes 13 and 15 and the XY board 33 is substantially decreased, and thus EMI is significantly reduced by, for example, a decrease of the differential mode radiation.

Figure 4:
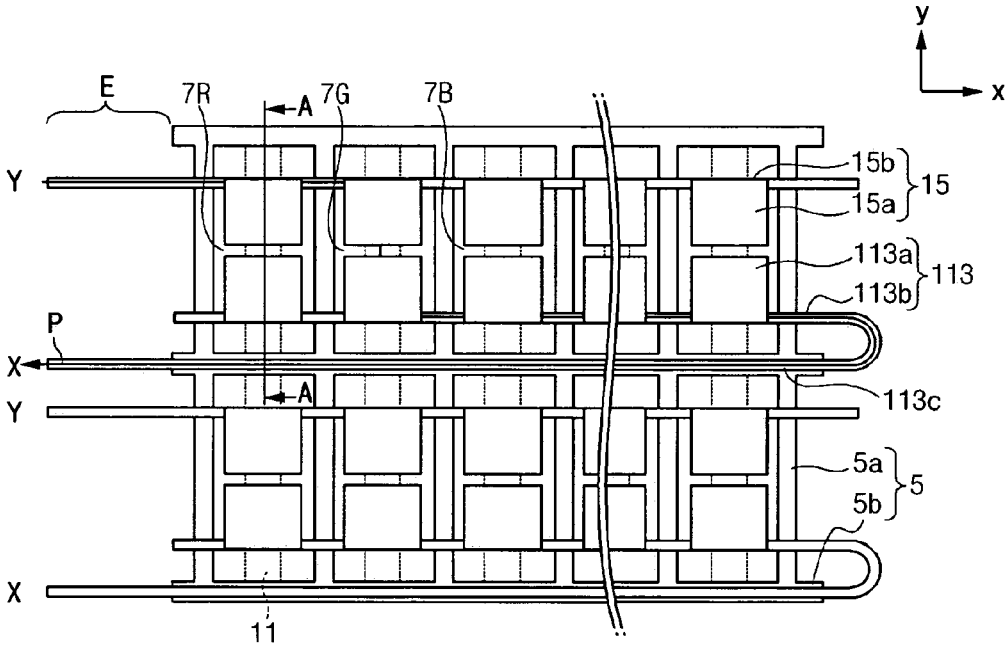
FIG. 4 is a top plan view showing principal portions of a PDP according to a second exemplary embodiment of the present invention.
Figure 5:
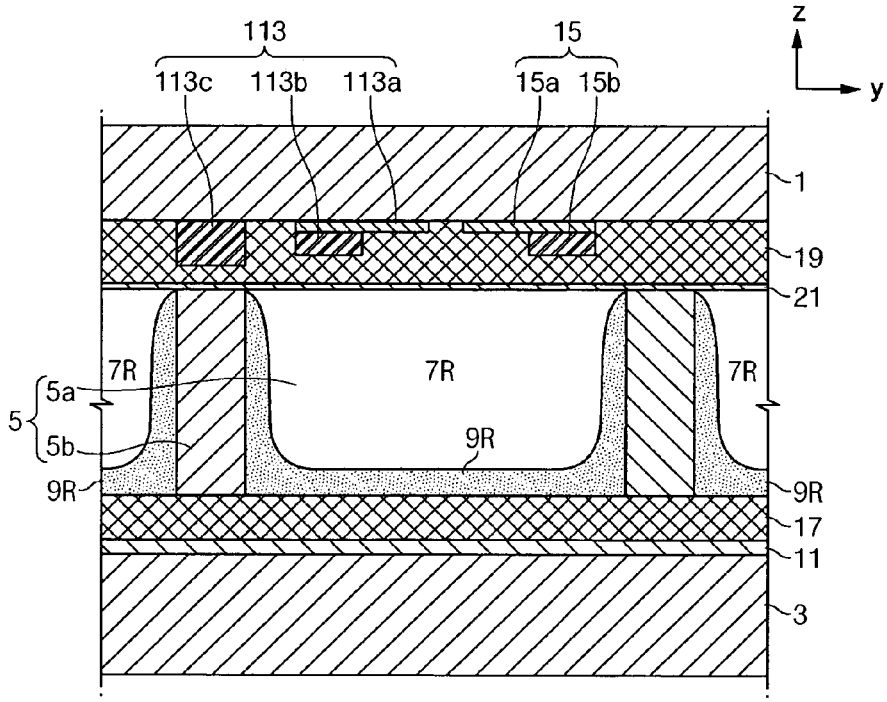
FIG. 5 is a cross-sectional view taken along the line A-A in FIG. 4.

FIG. 4 is a top plan view showing principal portions of a PDP according to a second exemplary embodiment of the present invention, and FIG. 5 is a cross-sectional view along the line A-A in FIG. 4.

A PDP according to the second exemplary embodiment is similar to the PDP according to the first exemplary embodiment in many ways, and accordingly, the description hereinafter is focused on the differences therebetween.

While the X and Y electrodes 13 and 15 are symmetrically formed according to the first embodiment, X and Y electrodes 113 and 15 of a PDP according to the second exemplary embodiment are formed different from each other.

The PDP according to the present embodiment includes Y electrodes 15 that are the same as have been described in connection with the first exemplary embodiment, and the Y electrodes 15 are elongated from their terminal E toward an opposite side thereof. The X electrodes 113 of the present embodiment have their terminals E in the same direction as the Y electrodes 15. The X electrode 113 further includes a first elongated portion 113*c* elongated from the terminal E of the X electrode 113 toward an opposite side thereof, and a second elongated portion 113*b* connected with the first elongated portion 113*c* and elongated back towards the terminal E. The second elongated portion 113*b* acts as a bus electrode, and corresponds to the bus electrode 13*b* of the first embodiment. Structural features of such X electrodes 113 and Y electrodes 15 may be oppositely formed. The X electrode 113 further includes a protrusion electrode 113*a* configured the same as the protrusion electrodes 13*a* in the first exemplary embodiment.

According to such a configuration of the Y electrodes 15 and the X electrodes 113, discharge current paths P are established with the same length for respective discharge cells 7R, 7G, and 7B. In this case, the length of the discharge current path P is substantially the same for all the discharge cells 7R, 7G, and 7B, and therefore, a brightness difference among the discharge cells 7R, 7G, and 7B may be substantially prevented.

The first elongated portion 113*c* forms a non-discharge portion that does not directly participate in the discharge, and is formed corresponding to the barrier rib 5 that forms a non-discharge area. In more detail, the first elongated portion 113*c* is formed on the first substrate 1 at a position corresponding to the second barrier rib member 5*b*. Therefore, the light emitted from the discharge cells 7R, 7G, and 7B is minimally blocked by the first elongated portion 113*c*, and hence, the brightness is not deteriorated.

In addition, the second elongated portion 113*b* forms a discharge portion that directly participates in the discharge. The first elongated portion 113*c* should be formed with a larger cross-section than that of the second elongated portion 113*b* (refer to FIG. 5), such that an increase of electrical resistance due to the lengthening of the discharge current path P may be compensated.

Since the X electrode 113 has first and second elongated portions 113*c* and 113*b*, while the Y electrode 15 is elongated in only one direction, the X and Y electrodes 113 and 15 are arranged in an order of Y, X, . . . , Y, and X electrodes or X, Y, . . . , X, and Y electrodes in the y-direction with respect to the discharge cells 7R, 7G, and 7B.

Figure 6:
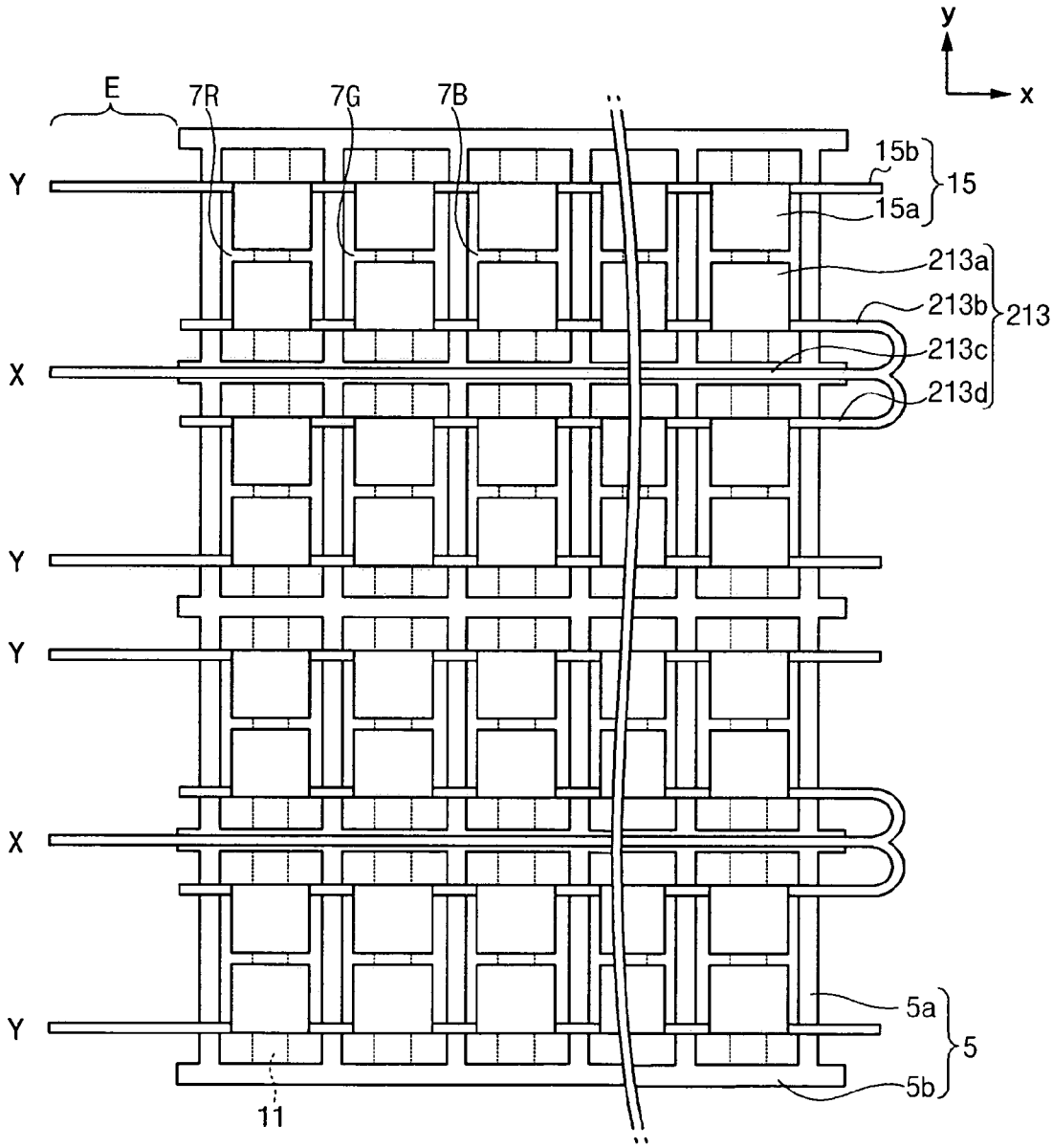
FIG. 6 is a top plan view showing principal portions of a PDP according to a third exemplary embodiment of the present invention.

FIG. 6 is a top plan view showing principal portions of a PDP according to a third exemplary embodiment of the present invention.

A PDP according to the third exemplary embodiment is similar to the PDP according to the second exemplary embodiment in many ways, and accordingly, the description hereinafter is focused on the differences therebetween.

As in the second exemplary embodiment, the X and Y electrodes 213 and 15 of a PDP according to the third exemplary embodiment are formed different from each other In addition, according to the third exemplary embodiment, second elongated portions 213*b* and 213*d* are dividedly branched from one first elongated portion 213*c*, and are respectively disposed in adjacent discharge cells 7R, 7G, and 7B, in the y-axis direction (i.e., the elongated direction of the address electrode 11). That is, the second elongated portions 213*b* and 213*d* are branched at an end of the first elongated portion 213*c* distal from the terminal E of the X electrode 213, and divided to proceed back toward the terminal E in opposite locations. Therefore, discharge cells 7R, 7G, and 7B adjacent along the address electrode 11 are driven in common by the X electrode 213.

In this case, the X and Y electrodes 213 and 15 are arranged in an order of Y, X, and Y, . . . , Y, X, and Y electrodes along consecutive discharge cells 7R, 7G, and 7B on the address electrode 11. According to such an electrode arrangement, the non-discharge area may be further removed from the vicinity of the X electrode 213 between adjacent discharge cells 7R, 7G, and 7B in comparison to the first and second exemplary embodiments, and accordingly, discharge efficiency may be enhanced.

Figure 7:
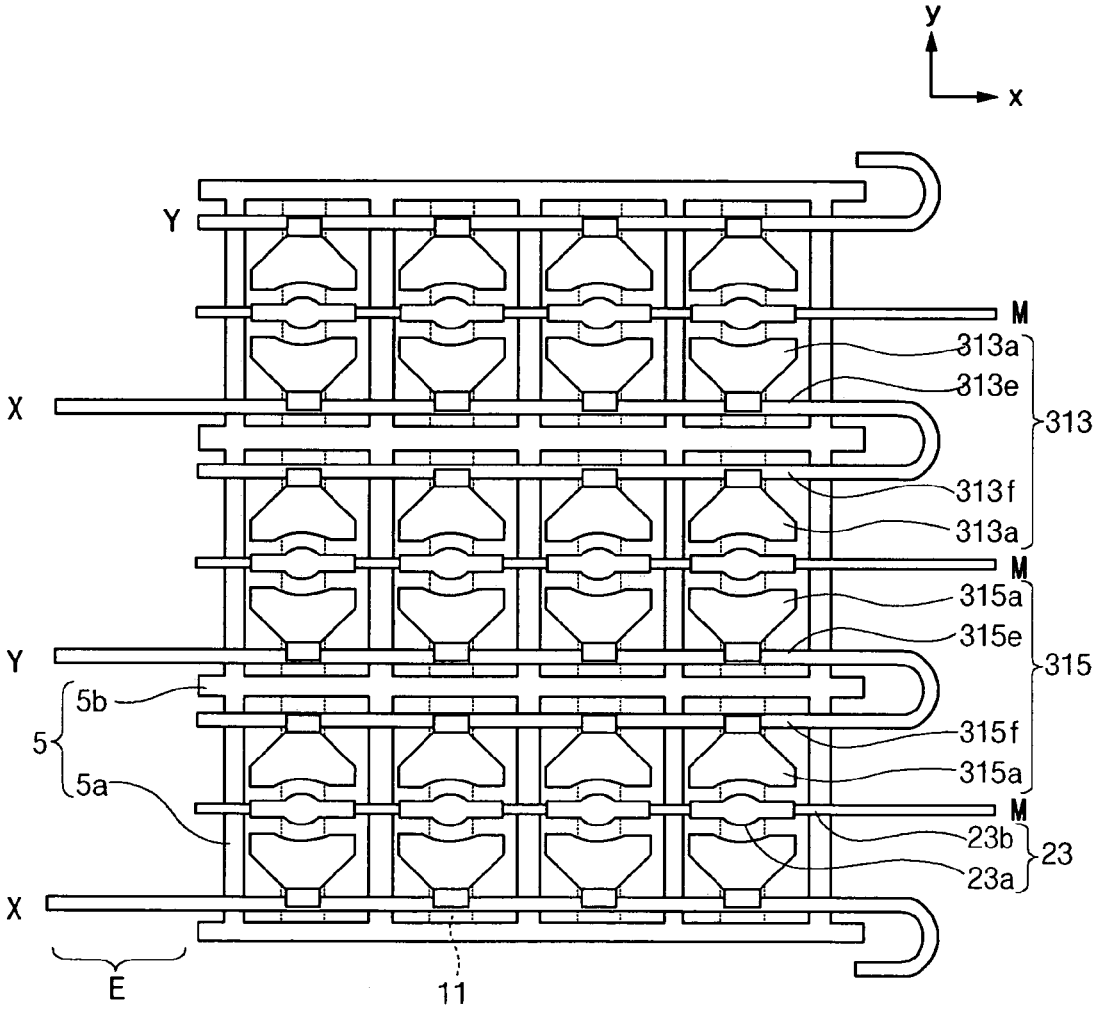
FIG. 7 is a top plan view showing principal portions of a PDP according to a fourth exemplary embodiment of the present invention.

FIG. 7 is a top plan view showing principal portions of a PDP according to a fourth exemplary embodiment of the present invention.

A PDP according to the fourth exemplary embodiment is similar to the PDP according to the third exemplary embodiment in many features, and accordingly, the description hereinafter is focused on the differences therebetween.

Differently from the third embodiment, the X and Y electrodes 313 and 315 of the present embodiment are formed to have the same shape.

That is, the X electrodes 313 have their terminals E in the same direction. Each X electrode 313 further includes a first elongated portion 313*e* elongated from the terminal E of the X electrode 313 toward an opposite side thereof, and a second elongated portion 313*f* connected with the first elongated portion 313*e* and elongated back toward the terminal E. The first elongated portion 31*e* and the second elongated portion 313*f* form discharge portions that directly participate in the discharge. The first elongated portion 313*e* and the second elongated portion 313*f* are respectively provided with a protrusion electrode 313*a* corresponding to the discharge cells 7R, 7G, and 7B.

In addition, the Y electrodes 315 have their terminals E in the same direction. Each Y electrode 315 further includes a first elongated portion 315*e* elongated from the terminal E of the Y electrode 315 toward an opposite side thereof, and a second elongated portion 315*f* connected with the first elongated portion 315*e* and elongated back toward the terminal E. The first elongated portion 315*e* and the second elongated portion 315*f* form discharge portions that directly participate in the discharge. The first elongated portion 315*e* and the second elongated portion 315*f* are respectively provided with a protrusion electrode 315*a* corresponding to the discharge cells 7R, 7G, and 7B.

That is, the second elongated portion 313*f* of the X electrode 313 and the first elongated portion 315*e* of the Y electrode 315 are disposed at one row of the discharge cells 7R, 7G, and 7B. In addition, the first elongated portion 313*e* of the X electrode 313 and the second elongated portion 315*f* of the Y electrode 315 are disposed at another row of the discharge cells 7R, 7G, and 7B that is adjacent to the above-mentioned one row of the discharge cells.

In this case, the X and Y electrodes 313 and 315 are arranged in an order of Y, X, Y, and X, . . . , Y, X, Y, and X electrodes along three consecutive discharge cells 7R, 7G, or 7B on the address electrode 11 along the y-axis. According to such an electrode arrangement, the non-discharge area may be further removed from the vicinity of both the X and Y electrodes 313 and 315 between adjacent discharge cells 7R, 7G, or 7B in comparison to the third exemplary embodiment, and accordingly, discharge efficiency may be further enhanced.

In addition, third electrodes (hereinafter called M electrodes) may be further included between the X electrodes 313 and the Y electrodes 315, respectively. The M electrode 23 applies a reset pulse waveform and a scan pulse waveform during a reset period and a scan period, respectively.

The M electrodes 23 include a plurality of bus electrodes 23*b* and a plurality of transparent electrodes 23*a*. The plurality of bus electrodes 23*b* are elongated in the x-axis direction crossing the length direction of the address electrode 11, and are formed by pairs in respective discharge cells 7R, 7G, and 7B. The transparent electrode 23*a* has wider width than the bus electrode 23*b*. The transparent electrode 23*a* may be elongated in the same way as the bus electrode 23*b*, and may protrude toward the protrusion electrodes 313*a* and 315*a* as shown in FIG. 7.

As described above, according to an exemplary embodiment of the present invention, terminals of display electrodes in a PDP are located at the same side of the PDP between front and rear substrates, and they are connected to an XY board provided on a chassis base through an FPC. Therefore, the area of the closed loop formed by the display electrodes and a driving board is decreased such that differential mode radiation of electromagnetic waves is reduced and consequently EMI is reduced. In addition, the driving boards for driving the X and Y electrodes may be formed as a single integral board, and accordingly, the driving circuit for driving the PDP may be simplified.

While this invention has been described in connection with certain exemplary embodiments, it is to be understood that the invention is not limited to the disclosed embodiments, but, on the contrary, is intended to cover various modifications and equivalent arrangements included within the spirit and scope of the appended claims and equivalents thereof.

What is claimed is:

1. A plasma display panel comprising:

a first substrate and a second substrate disposed facing each other;

a plurality of barrier ribs disposed between the first and second substrates and forming a plurality of discharge cells;

a phosphor layer formed in each of the discharge cells;

a plurality of address electrodes formed on the second substrate; and a plurality of display electrodes formed on the first substrate in a direction crossing the plurality of address electrodes, the display electrodes comprising first electrodes and second electrodes disposed opposite one another at each of the discharge cells, wherein each of the plurality of display electrodes has a terminal for receiving a driving voltage, each said terminal being located at a same left side or at a same right side of the plasma display panel as each other said terminal, and wherein each of at least one of the first electrodes or the second electrodes further comprises:

a first elongated portion extending from the terminal toward an opposite side of the plasma display panel; and a second elongated portion connected to the first elongated portion and extending in parallel to the first elongated portion, wherein the second elongated portion is located at a discharge area of the plasma display panel and the first elongated portion is not located at the discharge area of the plasma display panel, and wherein the first and second electrodes respectively comprise:

a bus electrode elongated in a direction crossing a length direction of the address electrodes, the bus electrode being formed corresponding to respective discharge cells in pairs, wherein the bus electrode comprises the second elongated portion in the at least one of the first electrodes or the second electrodes; and a plurality of protrusion electrodes protruding from the bus electrode toward a center of the respective discharge cells.

2. The plasma display panel of claim 1, wherein the first and second electrodes repeatedly correspond to respective said discharge cells in an order of the first electrode and the second electrode along an elongation direction of the address electrodes.

3. The plasma display panel of claim 1, wherein the first elongated portion has a larger cross-section than that of the second elongated portion.

* * * * *